US006884106B2

(12) United States Patent
Shuman et al.

(10) Patent No.: US 6,884,106 B2
(45) Date of Patent: Apr. 26, 2005

(54) ELECTRICAL CONNECTOR ASSEMBLY

(75) Inventors: Aaron J. Shuman, Harrisburg, PA (US); John R. Shuey, Mechanicsburg, PA (US); Neena Sooch, Sterling Heights, MI (US); Guy Willems, Knokke-Heist (BE)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/072,038

(22) Filed: Feb. 7, 2002

(65) Prior Publication Data

US 2003/0148651 A1 Aug. 7, 2003

(51) Int. Cl.[7] ..... H01R 13/627
(52) U.S. Cl. ..... 439/358; 439/352
(58) Field of Search ..... 439/358, 357, 439/350, 345, 352, 752, 595

(56) References Cited

U.S. PATENT DOCUMENTS

| | | | | |
|---|---|---|---|---|
| 4,634,204 A | | 1/1987 | Detter et al. | |
| 4,655,527 A | * | 4/1987 | Vandame | 439/350 |
| 4,946,404 A | * | 8/1990 | Takenouchi et al. | 439/352 |
| 5,120,255 A | | 6/1992 | Kouda et al. | |
| 5,344,335 A | * | 9/1994 | Scholz et al. | 439/357 |
| 5,507,666 A | | 4/1996 | Yamanashi | |
| 5,562,486 A | | 10/1996 | Saijo et al. | |
| 5,591,041 A | | 1/1997 | Cecil, Jr. et al. | |
| 5,604,572 A | | 2/1997 | Suzuki et al. | |
| 5,628,648 A | | 5/1997 | Higgins, Jr. et al. | |
| 5,628,649 A | | 5/1997 | Yagi et al. | |
| 5,643,003 A | * | 7/1997 | Myer et al. | 439/352 |
| 5,651,689 A | | 7/1997 | Plyler et al. | |
| 5,685,729 A | * | 11/1997 | Reider et al. | 439/206 |
| 5,692,923 A | * | 12/1997 | Sawada | 439/555 |
| 5,722,849 A | | 3/1998 | Alwine | |
| 5,820,387 A | | 10/1998 | Borisch et al. | |
| 5,823,814 A | | 10/1998 | Alwine | |
| 5,910,027 A | | 6/1999 | Wayt et al. | |
| 6,004,153 A | | 12/1999 | Myer et al. | |
| 6,045,388 A | | 4/2000 | Higgins et al. | |
| 6,093,045 A | | 7/2000 | Hoff | |
| 6,116,939 A | | 9/2000 | Fukuda | 439/354 |
| 6,179,643 B1 | * | 1/2001 | Fukuda | 439/358 |
| 6,319,023 B1 | | 11/2001 | Goto et al. | |
| 6,332,800 B1 | * | 12/2001 | Kodama | 439/357 |
| 6,447,170 B1 | * | 9/2002 | Takahashi et al. | 385/53 |

FOREIGN PATENT DOCUMENTS

| | | | |
|---|---|---|---|
| EP | 0 600 469 A1 | 6/1994 | H01R/13/436 |
| EP | 0 676 828 A2 | 10/1995 | H01R/13/46 |
| EP | 0 779 682 A2 | 6/1997 | H01R/13/74 |
| EP | 0 967 500 A2 | 12/1999 | G02B/6/38 |

* cited by examiner

*Primary Examiner*—Gary Paumen
*Assistant Examiner*—Edwin A. Leon

(57) ABSTRACT

An electrical connector assembly includes a plug having front end including a mating interface and a receptacle having an opening configured to receive the mating interface of the plug. A deflectable latch includes a beam having a front end secured with the front end of the plug housing and a rear, free-standing end which is biasable towards the plug to permit the plug and receptacle to be mated with one another. The latch includes first and second latching projections extending from opposite sides of the beam. First and second latch mating elements are positioned within the receptacle opening to securely engage the first and second latching projections when the plug and receptacle housings are fully mated with one another. The plug and receptacle include first and second mating keying features. One of the keying features is configured to prevent other plugs with mating interfaces of the same size from being inserted into the receptacle. The other keying feature being configured to prevent smaller plugs from being inserted into the receptacle. The overall envelope of the plug's mating interface is reduced by defining one of the keying features in a side wall of the plug opposite that of the latch, while defining the other keying feature in one of the top and bottom walls of the mating interface.

13 Claims, 15 Drawing Sheets

ELECTRICAL CONNECTOR ASSEMBLY

BACKGROUND OF THE INVENTION

The preferred embodiments of the present invention generally relate to electrical connectors with terminal position assurance, latching and keying features. More particularly, a latching connector assembly is provided affording a low vertical profile.

Many conventional connector configurations have been proposed, such as plug-receptacle assemblies for wire-to-wire connections, plug-receptacle assemblies for wire-to-printed circuit board connections (such as in board applications), and plug-device assemblies (such as sensors and the like). Hereafter the terms plug and receptacle shall be used to refer generically to any and all connector applications, including, but not limited to, wire to wire, PCB to wire, plug to device, and the like.

In many applications, several electrical connectors each consisting of a plug and associated receptacle, may be routed to a common area, such as on a vehicle. All of the connectors are connected when the vehicle reaches a designated point along an assembly line. Where several connectors of similar size and shape are provided, a need arises for assembly line personnel to be able to distinguish between connectors to ensure that each plug is inserted into the correct receptacle. In the past, assembly line personnel have experienced difficulties in discriminating each plug and the associated receptacle from other plugs and receptacles.

In the past, the issue of mismated connector halves has typically been addressed through the use of connector position assurance devices (CPA). A CPA functions to assure an operator that the matable connector halves have been correctly and fully mated. Conventional CPA systems, include a plug housing with a latch formed thereon. The latch slidably receives a CPA, which is mounted to the plug housing and is operable to assure that a further matable connection is fully mated to the housing before the CPA may be moved to its engaged position. However, conventional CPA and latch assemblies use a CPA carriage structure formed on top of the latch assembly, or visa versa. Stacking the CPA and latch upon one another unduly increases the overall envelope of the connector. With increasing demands being placed on miniaturization of connectors, a need exists to continue to further reduce the outer envelope of the connector device, while still providing a mechanism for assuring that assembly line personnel mate the correct connector assembly components together.

A need remains for improved connector assemblies that overcome the problems discussed above. The preferred embodiments of the present invention described below address the above discussed needs and other disadvantages of conventional connector devices that will become readily apparent from the following description, drawings and claims.

BRIEF SUMMARY OF THE INVENTION

According to certain aspects of an embodiment of the present invention, an electrical connector includes a plug having front end including a mating interface and a rear end. A receptacle has an opening configured to receive the mating interface of the plug. A deflectable latch includes a beam having a front end secured with the front end of the plug housing and a rear, free-standing end which is biasable towards the plug to permit the plug and receptacle to be mated with one another. The latch includes first and second latching projections extending from opposite sides of the beam. First and second latch mating elements are positioned within the receptacle opening to securely engage the first and second latching projections when the plug and receptacle housings are fully mated with one another.

The plug may include a cut out portion underling the rear end of the latch beam for permitting increased inward deflection of the latch beam relative to the plug. The rear end of the latch beam may include a beveled inner face for permitting increased inward deflection of the latch beam relative to the plug.

The first and second latching projections may be longitudinally aligned with one another along the length of the latch beam, or they may be longitudinally offset from one another.

According to certain other aspects of an embodiment of the present invention, a connector housing assembly includes a first plug having a mating interface. A receptacle has an opening configured to receive the mating interface of the first plug. A second plug has a mating interface sized to mate with the receptacle opening. A third plug has a mating interface which is smaller than the receptacle opening and therefore normally insertable into the receptacle opening. First and second keying features of the first plug mate with reciprocal keying features of the receptacle when the first plug is correctly mated with the receptacle. One of the receptacle keying features is configured to prevent the mating interface of the second plug from being fully inserted into the receptacle opening, while the other receptacle keying feature is configured to prevent the mating interface of the third plug from being fully inserted into the receptacle opening.

According to certain other aspects of an embodiment of the present invention, a method is provided for preventing incorrect interconnection of plugs and receptacles in an electrical connector system. The electrical connector system includes a first plug having a mating interface, a receptacle having an opening configured to receive the mating interface of the first plug, a second plug having a mating interface sized to mate with the receptacle opening, and a third plug having a mating interface which is smaller than the receptacle opening and therefore normally insertable into the receptacle opening. A method for preventing the second and third plugs from being mated with the receptacle, comprises providing first and second plug keying features on the first plug which are configured to mate with first and second receptacle keying features on the receptacle. According to the method, one of the receptacle keying features is configured to prevent the mating interface of the second plug from being fully inserted into the receptacle opening, while the other receptacle keying feature is configured to prevent the mating interface of the third plug from being fully inserted into the receptacle opening.

Figure 1:
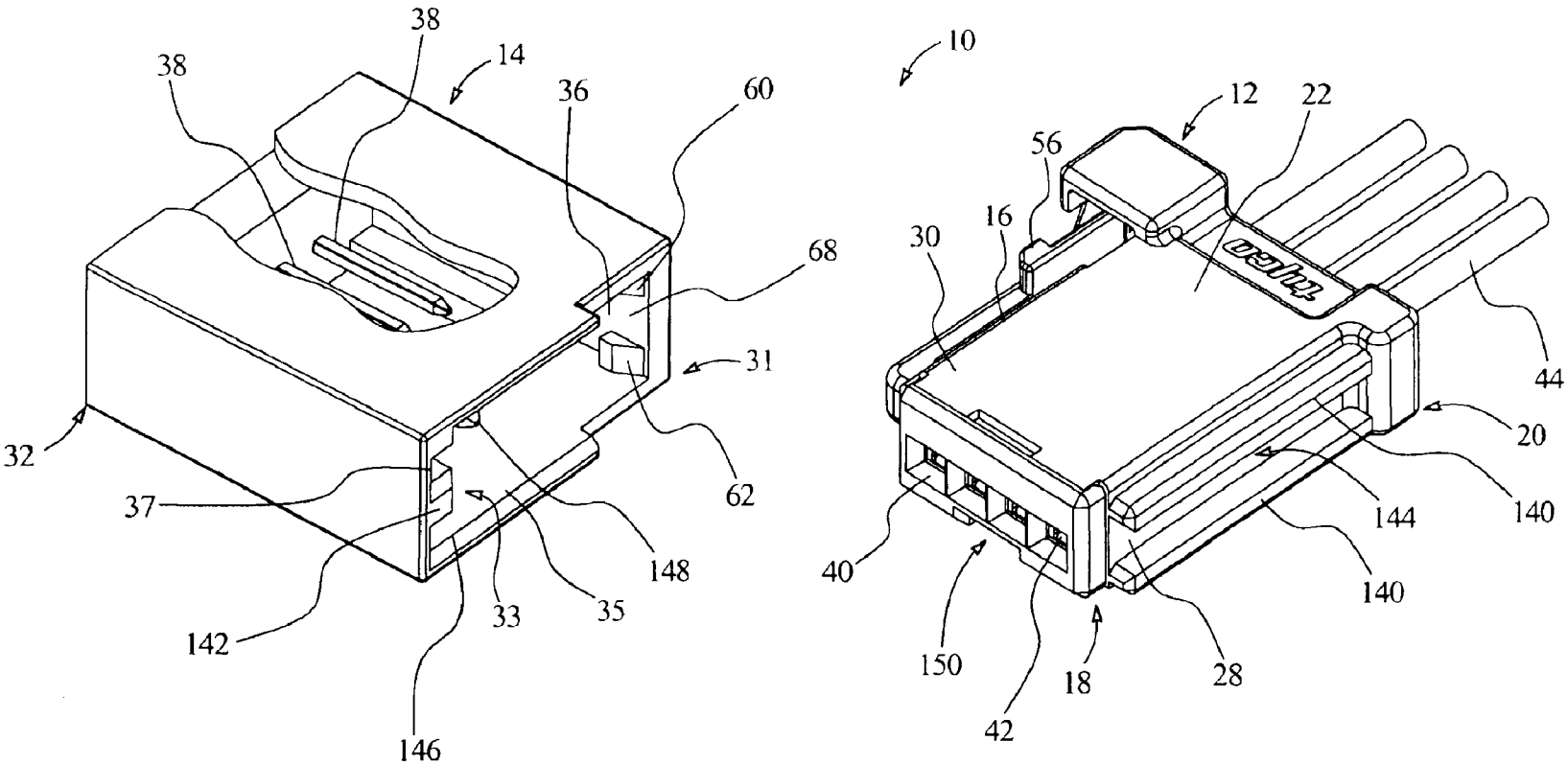
FIG. 1 is a top perspective view of a electrical connector assembly according to certain aspects of an embodiment of the present invention.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

Figure 2:
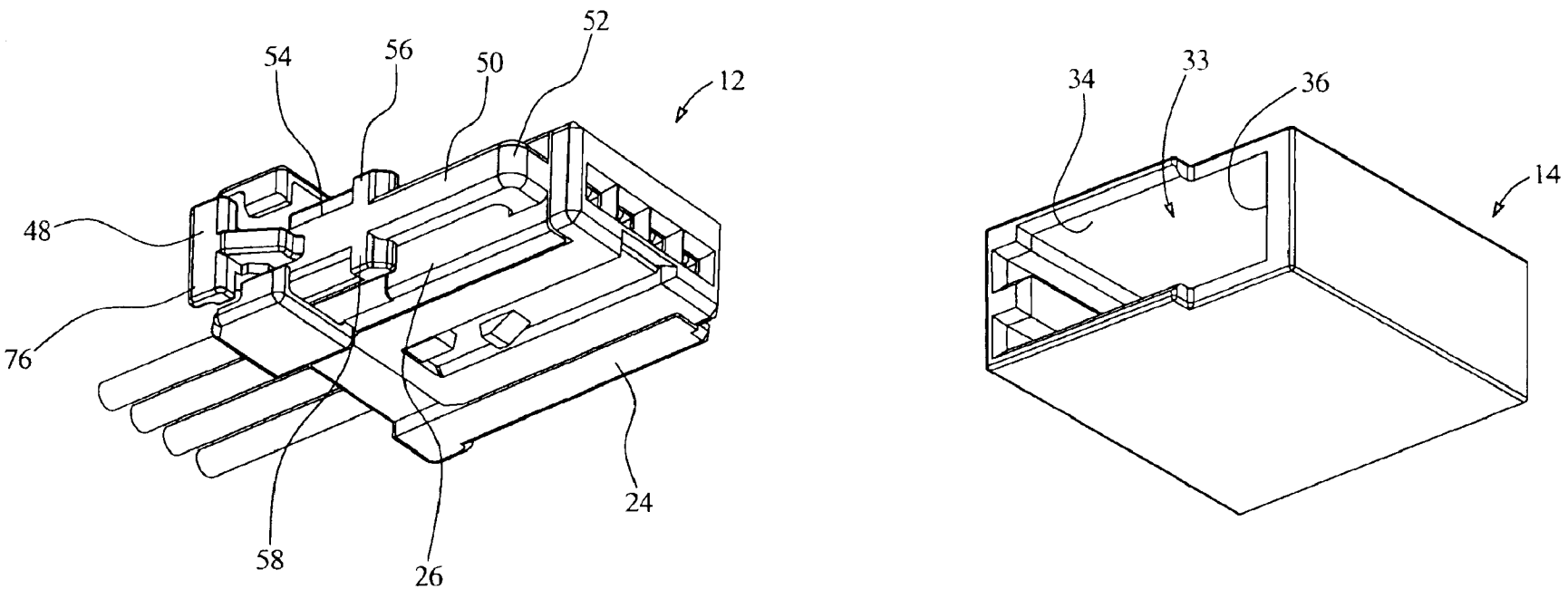
FIG. 2 is a bottom perspective view of the electrical connector assembly of FIG. 1.
Figure 3:
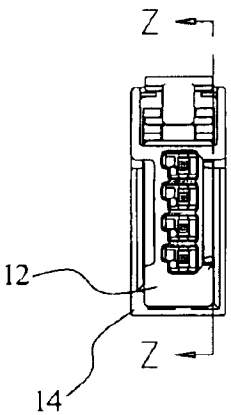
FIG. 3 is an elevation view of the connector assembly of FIG. 1 showing a plug mated to a receptacle.

Referring now to FIGS. 1 and 2, an electrical connector 10 constructed in accordance with certain aspects of the present invention includes a plug 12 and a receptacle 14. The plug 12 includes a housing 16 (see additionally FIGS. 7–12) having a front or mating end 18 and a rear end 20. The housing includes a top wall 22, a bottom wall 24, and first and second side walls 26, 28 which define a mating interface 30 on the front end 18 of the housing 16.

The receptacle 14 includes a front or mating end 31 and a rear end 32. The front end 31 of the receptacle 14 presents an opening 33 which is sized to receive the mating interface 30 of the plug 12. The opening includes a top wall 34, a bottom wall 35 and first and second side walls 36, 37. The receptacle 14 includes a plurality of electrical terminals in the form of contact pins 38 positioned in the receptacle opening 33. The receptacle pins 38 are configured and positioned to extend through reciprocal terminal openings 40 formed on the front face of the plug 12 when the plug 12 is mated with the receptacle 14. The receptacle pins 38 pass through the openings 40 and engage with reciprocal electrical contact terminals 42, which are contained within the plug housing 16. The rear ends of the plug terminals 42 are connected to electrical conductors 44, such as wires, from a wiring harness or another device (not shown). The terminals 38, 42 are arranged in a predetermined pattern of rows and columns, as is common in the art. In the art, such connectors are typically referenced as A×B connectors, where A represents the number of rows of terminals and B represents the number of terminals in each row. In the illustrated embodiment, the plug 12 and receptacle 14 each include a single row of 4 (four) terminals. Hence, the illustrated electrical connector is a 1×4 connector. It will be appreciated, however, that the present invention is equally applicable to other connector sizes.

The plug 12 includes a latching member 48 formed on one side thereof. The latching member 48 may be formed on the top, bottom or either side wall of the plug housing 16, but is preferably formed on one of the side walls 26, 28. In the illustrated embodiment, the latching member 48 is formed on the first side wall 26 of the plug housing 16. The latching member 48 may be formed integrally with the plug housing 16. Alternatively, the latch member 48 may be mounted to the plug housing 16 as a separate unitary structure affixed to the plug housing 16 in any of several manners, such as through adhesive, glue, snaps, screws and other fastening means.

The latching member 48 includes a beam 50 which extends longitudinally along the first side wall 26 of the plug housing 16. The beam 50 has a front end 52 secured with the front end 18 of the plug housing 16. The beam 50 has a rear, free standing end 54, which is normally laterally spaced from the plug housing 16. The rear end 54 of the beam 50 is biasable inward towards the plug housing 16 to permit the plug 12 and receptacle 14 to be mated with one another. The latch beam 50 includes first and second opposed latching projections 56, 58 extending from opposite sides of the latch beam 50. In the illustrated embodiment, the latch projections 56, 58 are longitudinally aligned with each other along the length of the beam 50. It will be appreciated, however, that the latch projections 56, 58 could be longitudinally offset from each other. First and second latch mating elements 60, 62 are formed within the receptacle opening 36. The first and second latch mating elements 60, 62 are positioned to securely engage the first and second latching projections 56, 58 when the plug 12 is inserted into the receptacle opening 33. In the illustrated embodiment, the latch mating elements 60, 62 are in the form of protrusions which extend inwardly from the first side wall 36 of the receptacle opening 33. It will be appreciated, however, that the latch mating elements 60, 62 could take other forms, such as indentations formed in the side wall of the receptacle opening 33.

The latching member 48 of the illustrated embodiment provides several advantages. By positioning the latching member 48 on the side of the plug 12, as opposed to the top or bottom, the overall height of the plug, and hence the connector 10 is reduced. In this respect, the overall height of the latching member 48, as measured between the outer edges of the latching projections 56, 58, is preferably substantially the same as the height of the mating interface 30 of the plug 16. In addition, the single beam design with opposed latching projections 56, 58 enables the area of latch engagement to be maximized for a given height restriction.

Referring additionally to FIGS. 3–6, operation of the latching mechanism will be explained in greater detail. When the mating interface 30 of the plug 12 is inserted into the receptacle opening 33, the front end 52 of the beam 50 slides into a gap 68 (see FIG. 1) formed between the latch mating elements 60, 62. The plug 12 is pushed inwardly into the receptacle opening 33 until the front faces of the latching projections 56, 58 engage against the latch mating elements 60, 62. The front faces of the latch projections 56, 58 and the reciprocal projections in the receptacle may be beveled (as shown) to ease the insertion of the plug 12 into the receptacle 14. As the plug 12 continues to move inwardly into the receptacle 14, the latch mating elements 60, 62 exert forces against the latch projections 56, 58, which biases the rear end 54 of the beam 50 inwardly towards the side wall 26 of the plug housing 16. The plug's mating interface 30 continues to move inwardly until the rear ends of the latch projections 56, 58 move beyond the rear ends of the latch mating elements 60, 62. Once the latch projections 56, 58 move inwardly beyond the latch mating elements 60, 62, the rear end 54 of the latch beam 50 springs outwardly to its first position thereby locking the plug 12 into the receptacle 14. (See FIG. 6).

Figure 6:
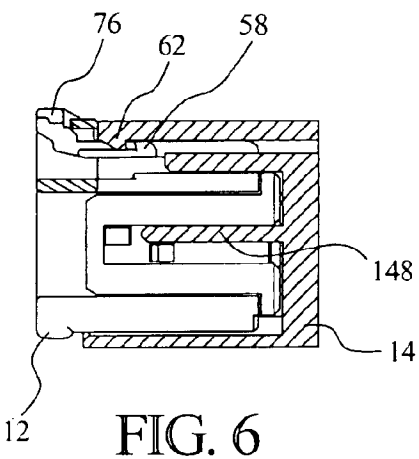
FIG. 6 is a cross-sectional view from the same perspective as FIG. 4, showing the plug fully engaged into the receptacle.
Figure 5:
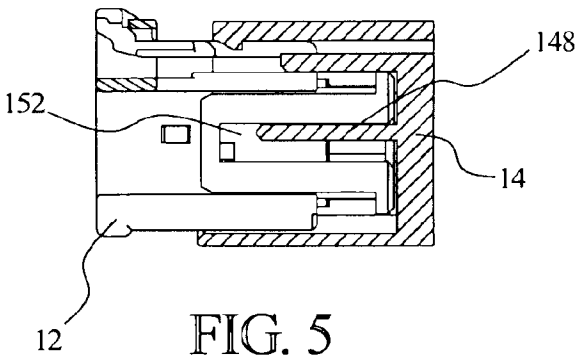
FIG. 5 is a cross-sectional view from the same perspective as FIG. 4, showing the plug partially engaged into the receptacle.
Figure 4:
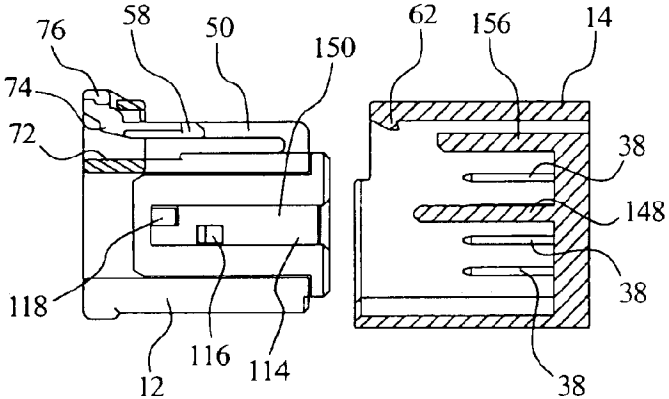
FIG. 4 is a bottom cross-sectional view along line Z—Z of FIG. 3, showing the plug disengaged from the receptacle.
Figure 7:
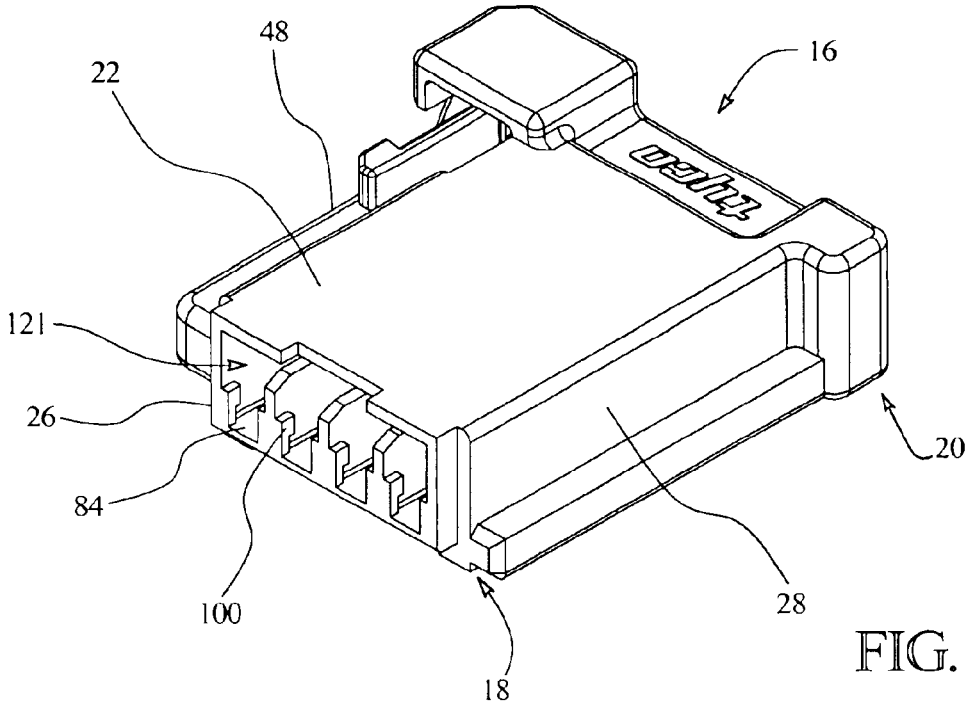
FIG. 7 is a top front perspective view of a plug housing from the plug shown in FIG. 1.
Figure 8:
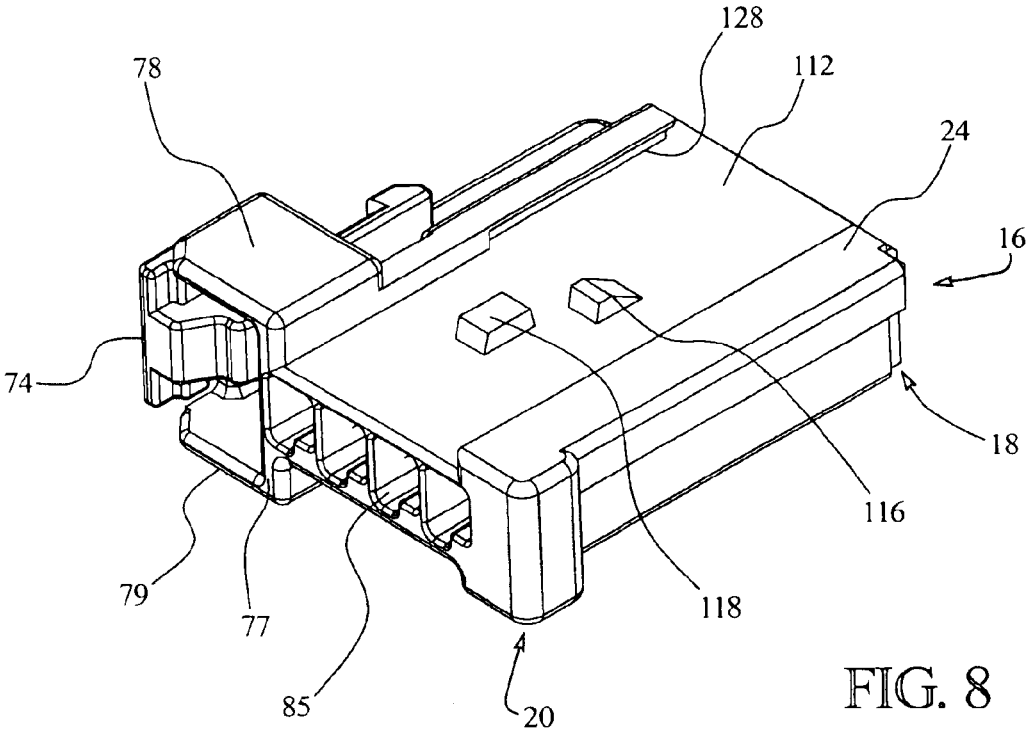
FIG. 8 is a bottom rear perspective view of the plug housing of FIG. 7.
Figure 9:
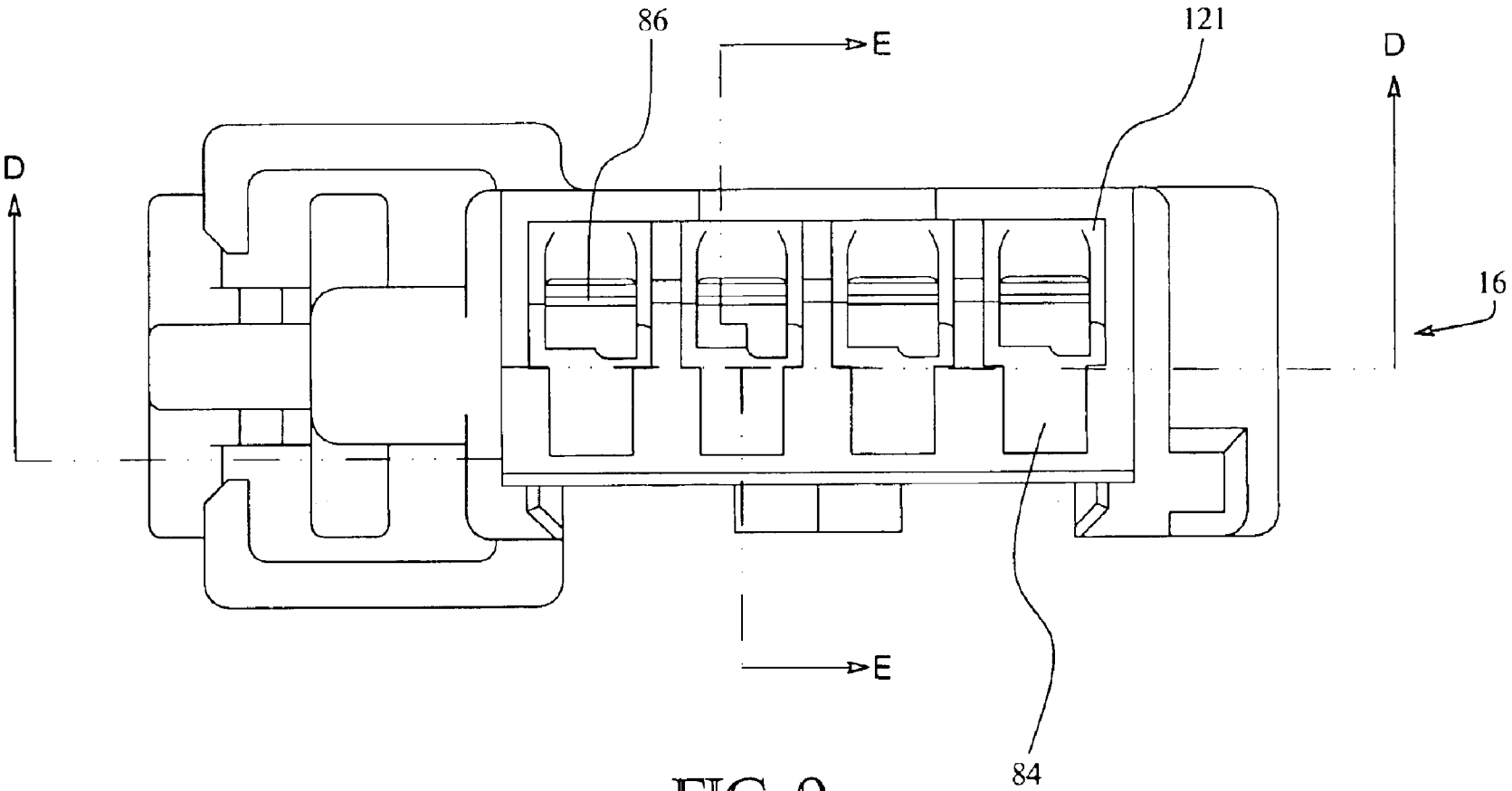
FIG. 9 is a front elevation view of the plug housing of FIG. 7.
Figure 10:
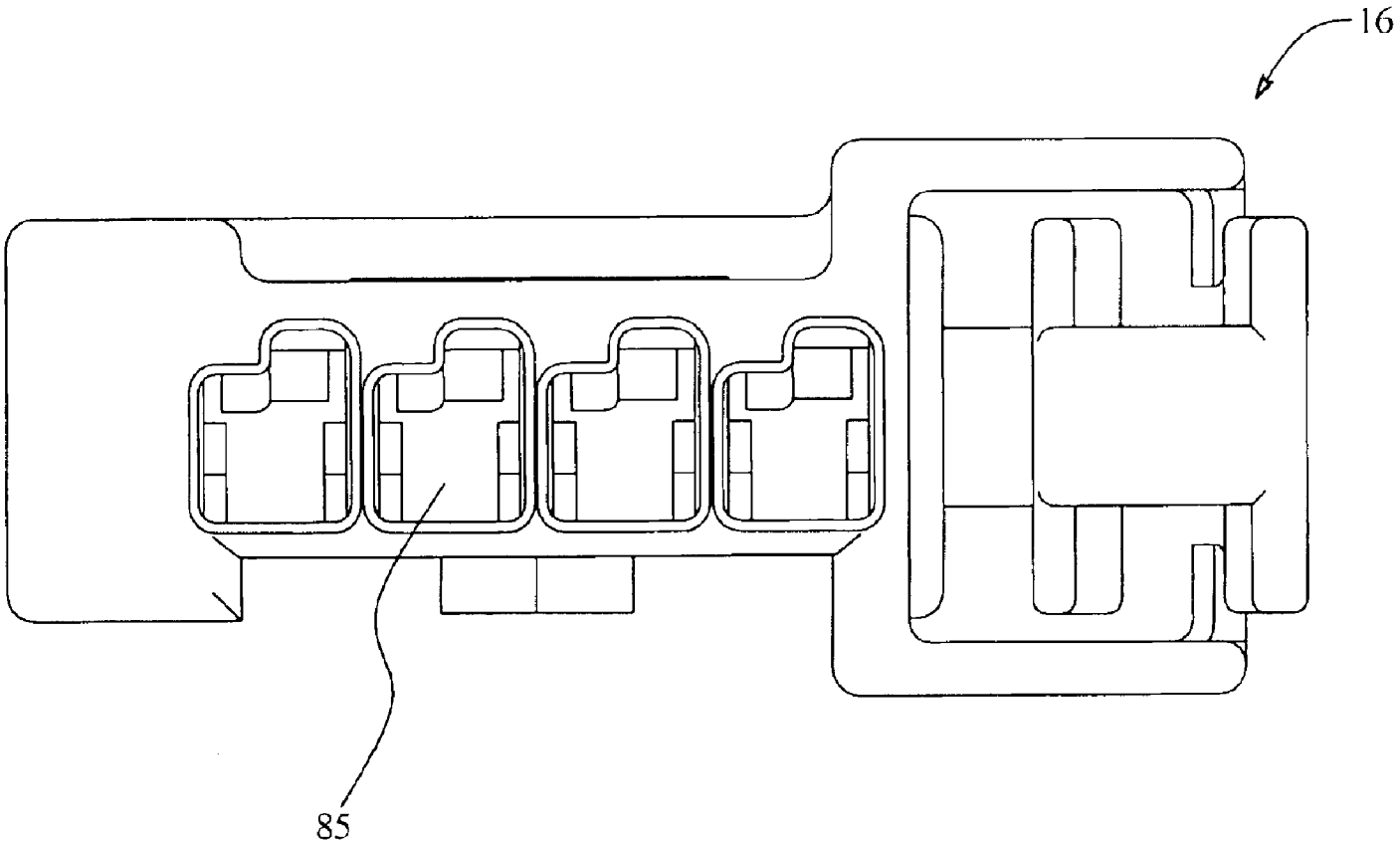
FIG. 10 is a rear elevation view of the plug housing of FIG. 7.
Figure 11:
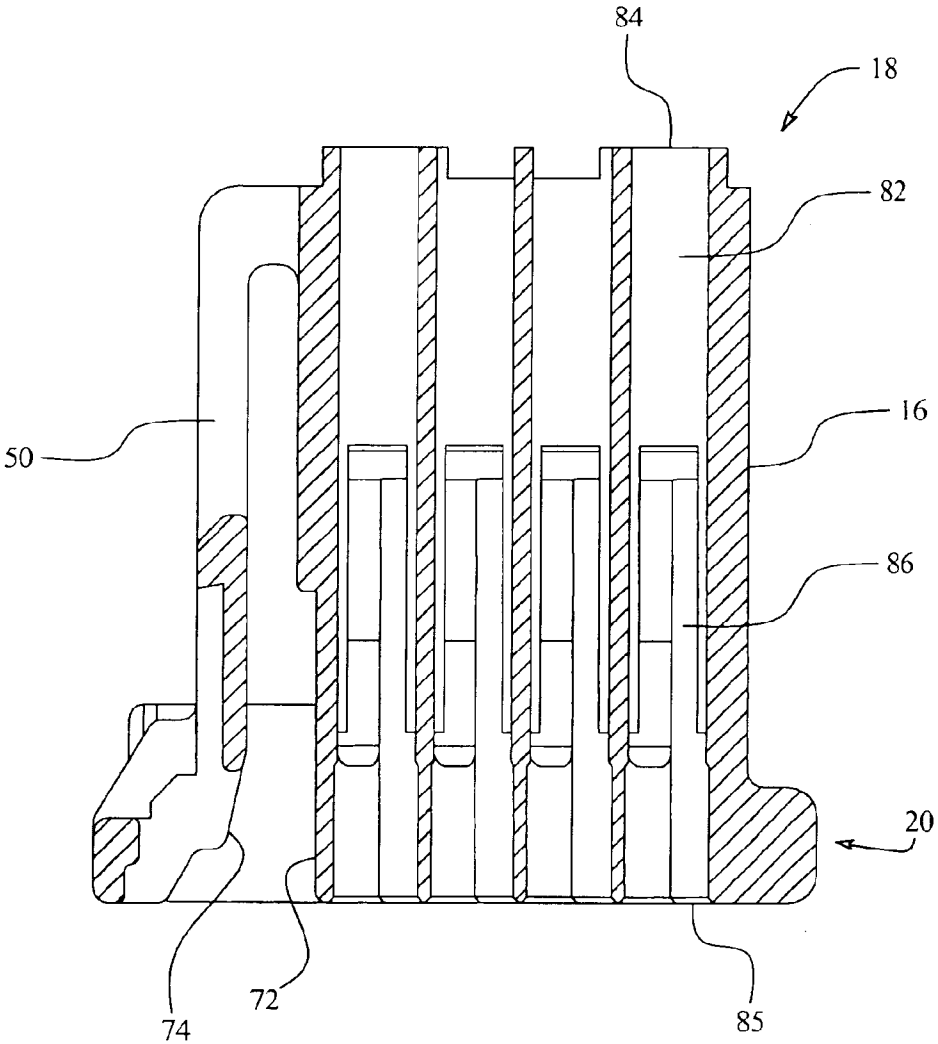
FIG. 11 is a cross-sectional view along line D—D of FIG. 9.

As can be seen in FIG. 4, the first side wall 26 of the plug housing 16 includes a cut out portion 72 which underlies the rear end 54 of the latch beam 50. The cut out portion 72 functions to allow increased inward deflection of the latch beam 50 relative to the plug housing 16. In addition, the rear end 54 of the latch beam 50 includes a beveled inner face 74 which also functions to permit increased inward deflection of the latch beam 50 relative to the plug housing 16. The rear end of the latch beam 50 include a handle 76 for operating the latch member 48. As can be seen in FIG. 6, the handle 76 is positioned outside of the receptacle 14 when the plug 12 is mated with the receptacle. The handle 76 can be depressed to move the latch beam 50 inwardly to allow the plug 12 to be removed from the receptacle 14. A shroud 77 is formed around the rear end 54 of the latch beam 50. The shroud 77 includes top and bottom walls 78, 79 which overlie the rear end of the beam 50. The shroud functions to protect the portion of the latch mechanism 48 which would otherwise be exposed when the plug 12 and receptacle 14 are mated together. Shroud 77 also serves as an overstress feature preventing overstressing of the latch if deflected outwardly from the plug housing.

Figure 17:
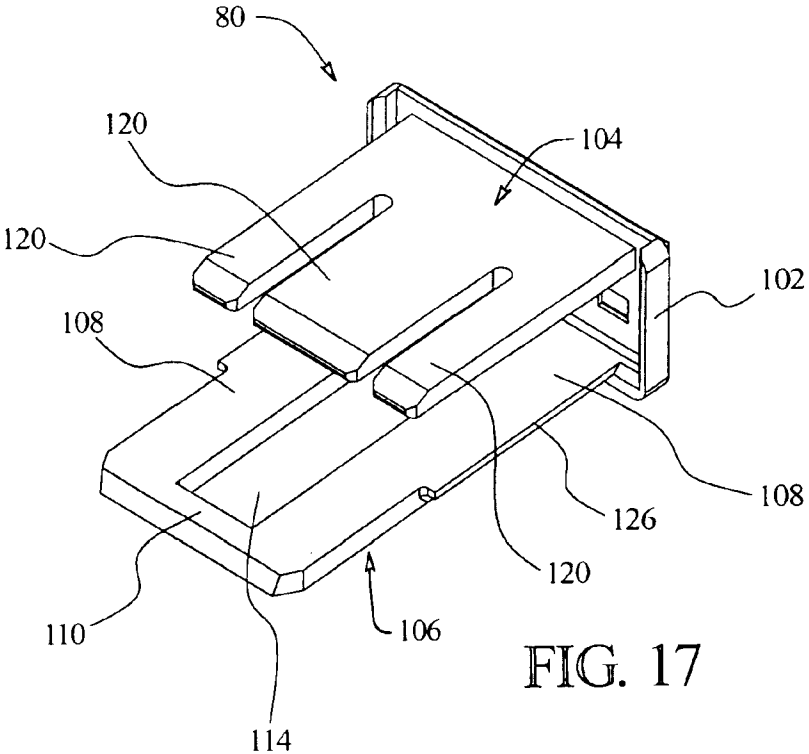
FIG. 17 is a top rear perspective view of the TPA of FIG. 16.
Figure 16:
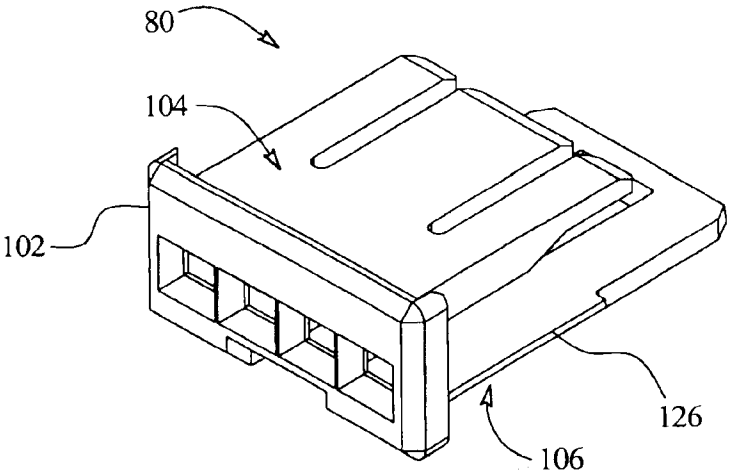
FIG. 16 is a top front perspective view of a terminal position assurance device (TPA) from the plug of FIG. 1.
Figure 18:
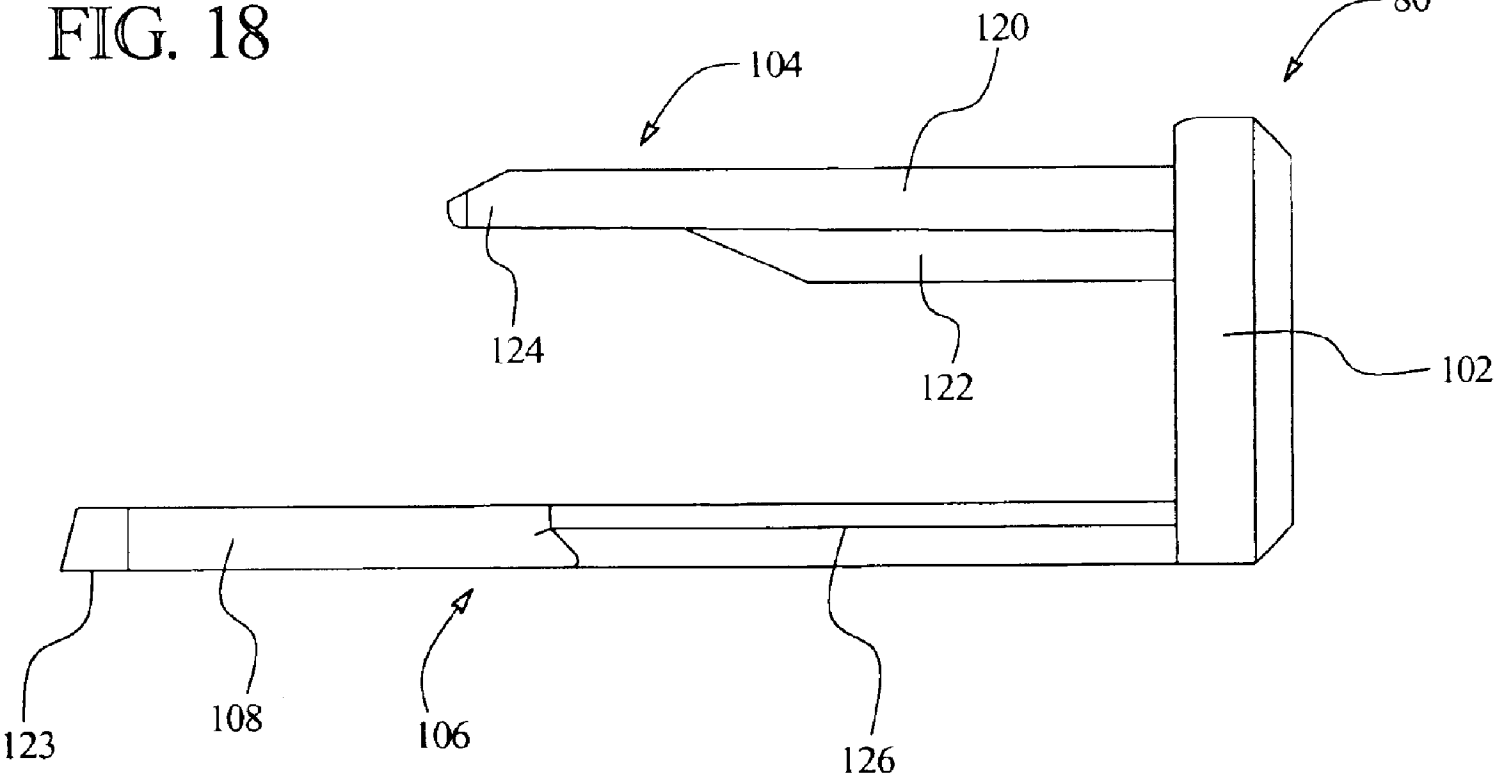
FIG. 18 is a side elevation view of the TPA of FIG. 16.
Figure 19:
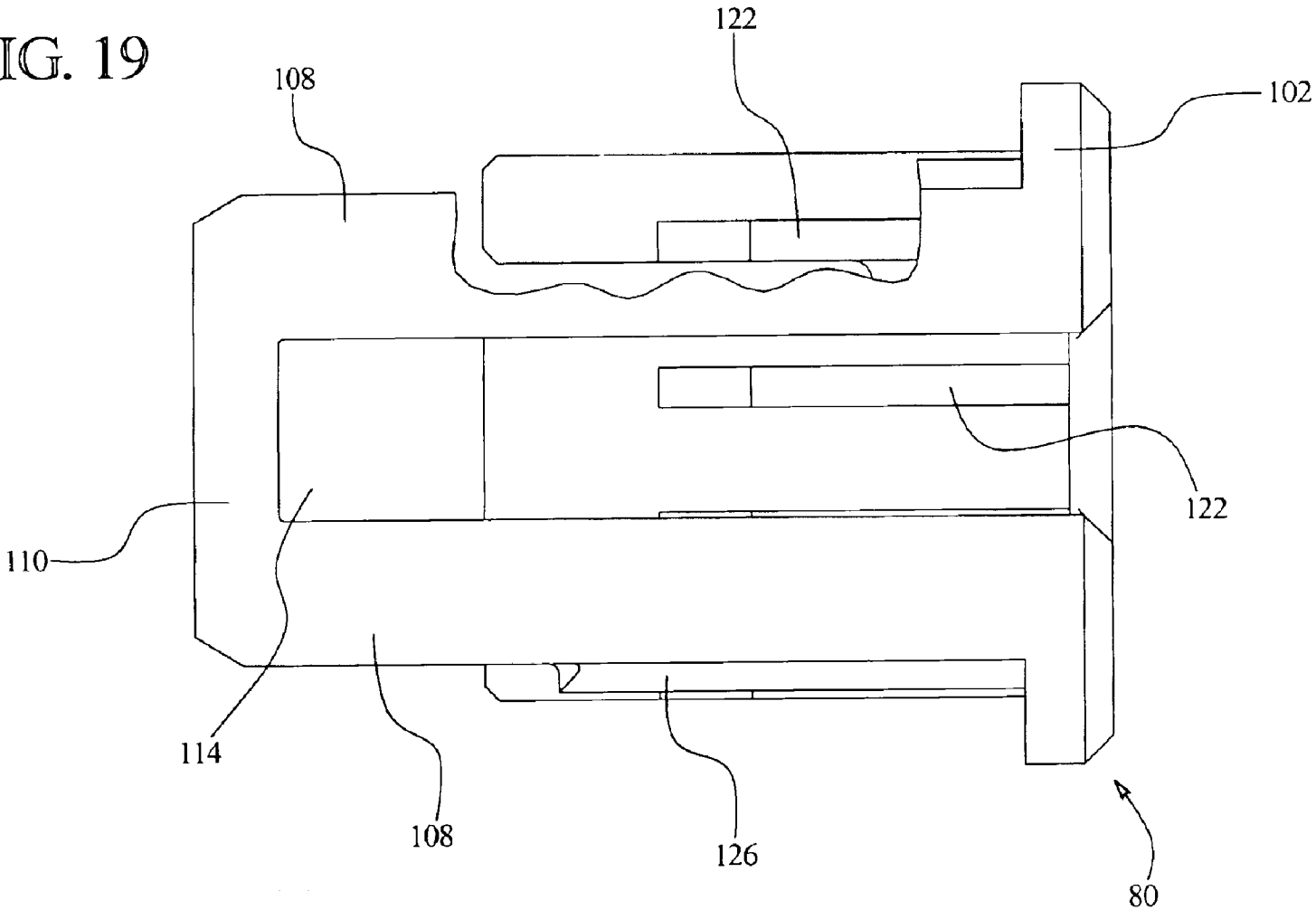
FIG. 19 is a bottom cutaway elevation view of the TPA of FIG. 16.
Figures 20A, 20B, 20C, 20D:
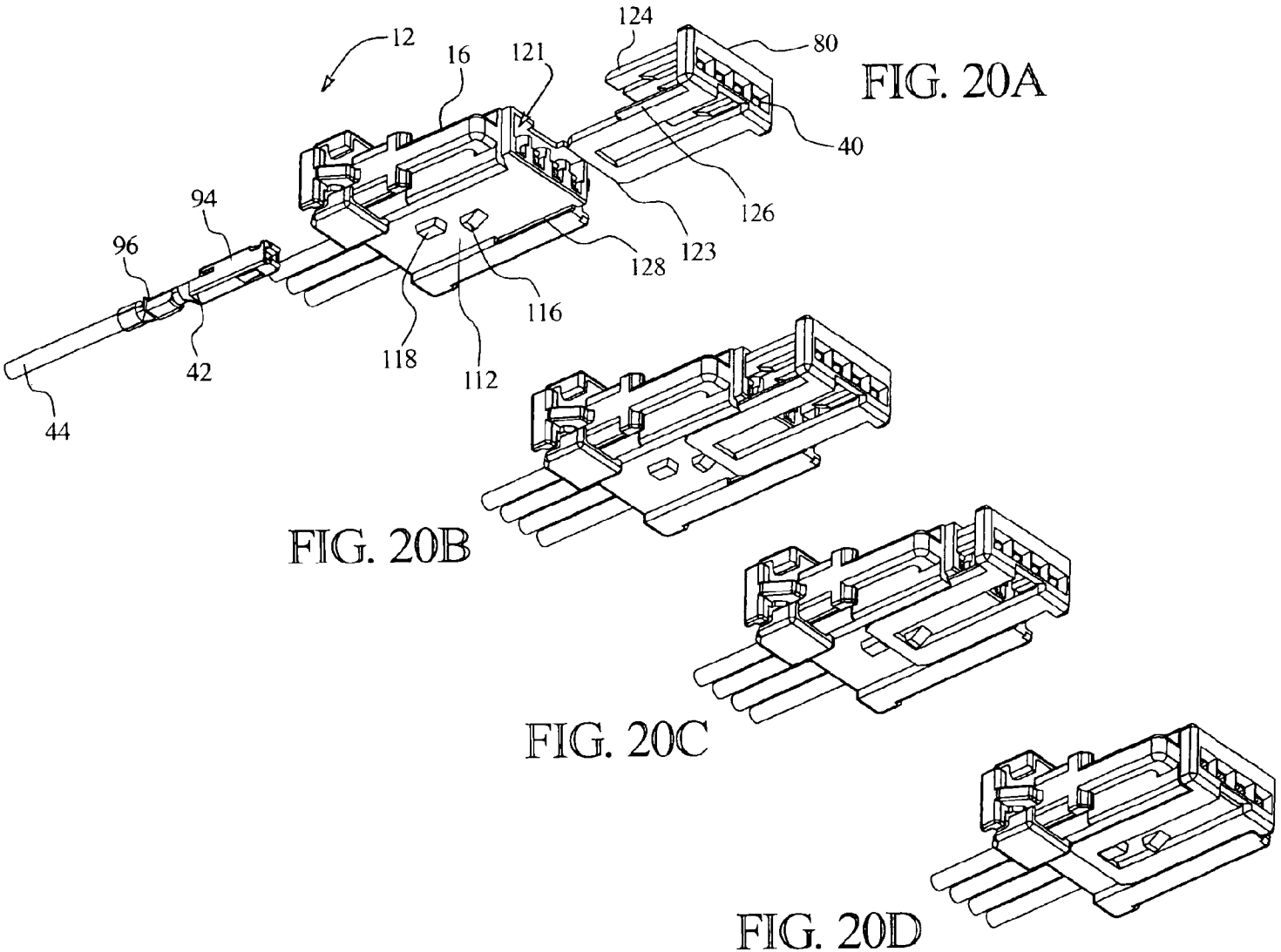
FIGS. 20A–20D are a sequence of exploded views illustrating assembly of a plug from the electrical connector assembly of FIG. 1.

The plug 12 includes the housing 16 (see FIGS. 7–15) and a terminal position assurance device (TPA) 80 (see FIGS. 17–19) which is configured to mate with the plug housing (see FIGS. 20A–20D). As was discussed above, the plug housing 16 includes a top wall 22, a bottom wall 24 and first and second opposed side walls 26, 28. Terminal receiving passages 82 extend between the front and rear ends 18, 20 of the housing 16 (see FIGS. 11 and 12). Each passage 82 is configured to receive and support one of the plug terminals 42 within the housing 16. The passages present openings 84 in the front end 18 of the housing 16, which are arranged in a predetermined pattern to allow the plug terminals 42 to mate with the receptacle pins 38 when the plug 12 is inserted into the receptacle 14. The passages 82 also include rear openings 85 which are configured to allow the terminals to be inserted into the plug housing 16 during assembly of the plug 12, as is explained in greater detail below.

Figure 12:
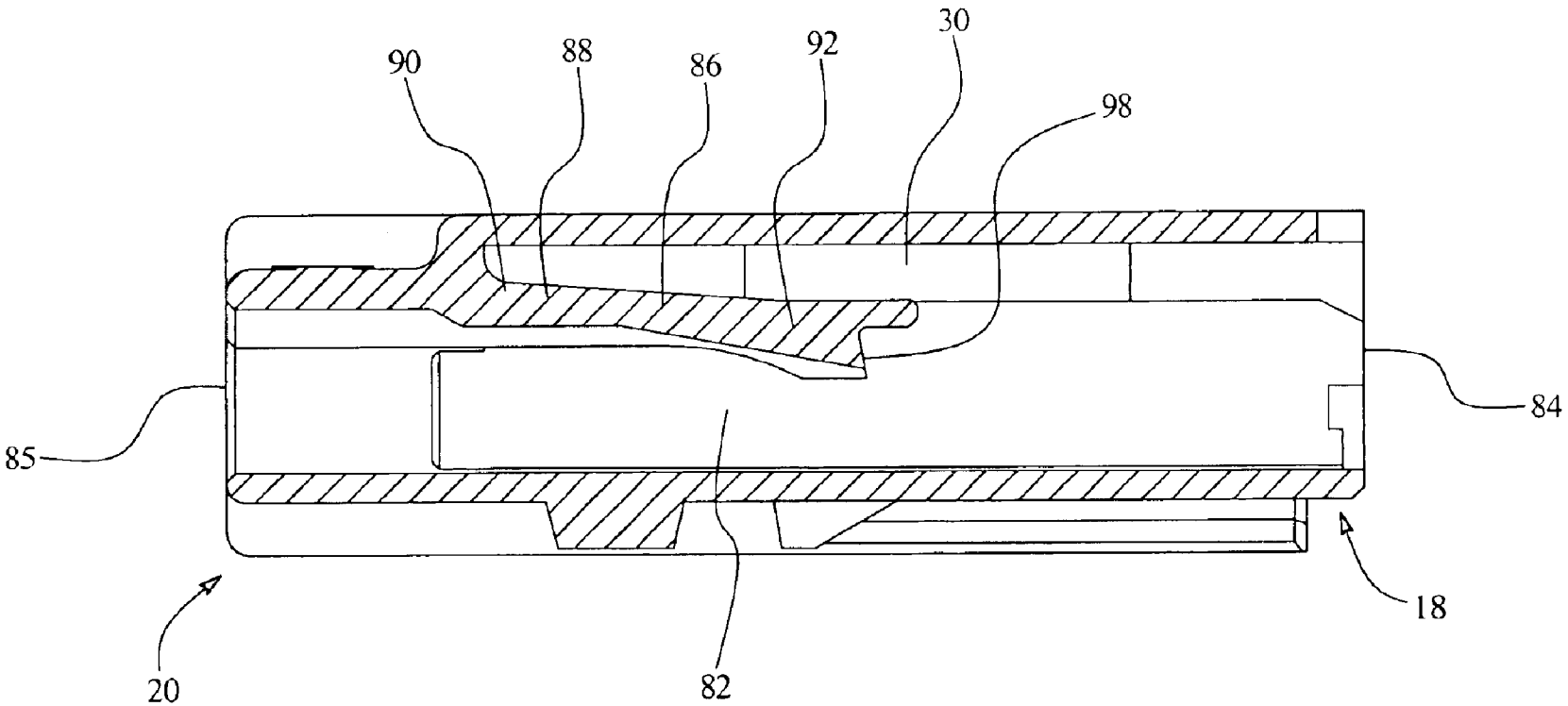
FIG. 12 is a cross-sectional view along line E—E of FIG. 9

As can be seen in FIG. 12, each passage 82 includes a latching member 86 for securing the plug terminal 42 within the passage. The latch member 86 includes an arm or beam 88 extending longitudinally within a respective passage 82. The beam 88 has a rear end 90 connected to housing 16 at the rear end of the passage 82 and front, free standing end 92 which can be pivoted towards the upper wall of the passage 82 to allow a plug terminal 42 to be inserted into the passage 82.

Figure 14:
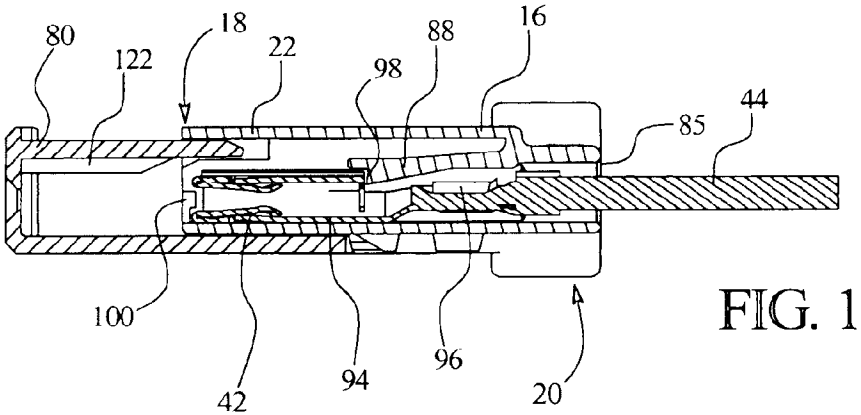
FIG. 14 is a cross-sectional view along line A—A of FIG. 13, showing the TPA in its preset position.
Figure 15:
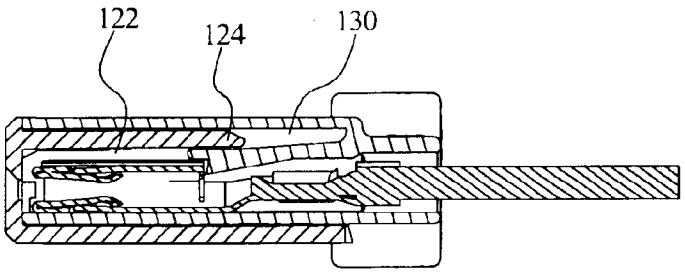
FIG. 15 is a cross-sectional view similar to FIG. 13, but illustrating the TPA fully engaged with the plug housing.
Figure 13:
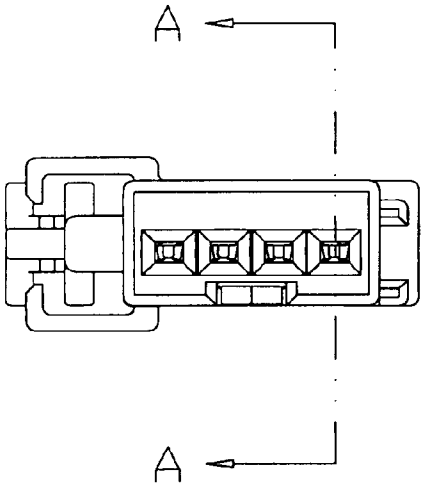
FIG. 13 is a front elevation view of the plug of FIG. 1.

Referring to FIGS. 12–15, the manner in which the terminals 42 are installed in the housing will be explained. During assembly, the plug terminals 42, which have previously been secured to the conductors 44, are inserted into the passages 82 through the rear openings 85. As can be seen in FIG. 17A, each of the plug terminals 42 includes a front portion 94, which is configured to receive a receptacle pin 38, and a rear portion 96, which is configured to be secured to one of the conductors 44. As a plug terminal 42 is inserted into one of the passages 82, the front portion 94 of the terminal 42 engages against the bottom of the latch beam 88. The lower face of the latch beam 88 may be beveled as shown to ease insertion of the terminal 42 into the passage 82. Continued inward movement of the plug terminal 42 biases the latch beam 88 upwardly. The plug terminal 42 continues to move inwardly into the passage 82 until its front portion 94 moves inwardly of a locking finger 98 formed on the front end 92 of the latch beam 88. Once the front portion 94 of the terminal 42 moves beyond the latching finger 98, the latch beam 88 springs downwardly to secure the terminal 42 within the passage 82, as is shown in FIGS. 14 and 15. The terminal 42 is restrained in the passage 82 between the locking finger 98 and a protrusion 100 formed on the front end of the passage 82.

Referring to FIGS. 16–19, the TPA 80 has a front wall 102, and top and bottom opposed latching members 104, 106 extending from the front wall. The top and bottom latching members 104, 106 are configured to secure the TPA 80 to plug housing 16 for movement between a first or preset position (see FIG. 20C) and a second or fully engaged position (see FIG. 20D). The front wall 102 carries the terminal opening 40. When the TPA 80 is in its fully engaged position, the terminal openings 40 align with and overly the front openings 84 of the passages 82.

The bottom latching member 106 includes a pair of bottom legs 108 which are connected at their distal ends by a cross member 110. The bottom latching member 106 is configured to slide into a reciprocal recess 112 formed in the bottom wall 24 of the plug housing 16, as is shown in FIGS. 20A–20D. A longitudinal slot 114 extends between the bottom legs 108. The longitudinal slot 114 is configured to mate with first and second longitudinally spaced latching protrusions 116, 118 (see FIG. 8), which are formed in the recess 112, for allowing the TPA 80 to be secured to the housing 16 at its preset and fully engaged positions, as is explained below.

The top latching member 104 of the TPA 80 includes a plurality of top legs 120 (three in the illustrated embodiment). The top legs 120 are insertable into top passage 121 in the plug housing 16. The top passage 121 overlies and opens into the terminal passages 82. The top legs 120 present downwardly extending protrusions 122. Each of the protrusions 122 is positioned to align with and extend downwardly into one of the terminal passages when the TPA 80 is moved to its fully engaged position. (See, e.g., FIG. 15).

Assembly of the plug will now be explained with reference to FIGS. 14, 15 and 20A–20D. The TPA 80 is secured to the plug housing 16 by initially sliding the distal end 123 of the bottom latching member 106 into the recess 112. As the TPA 80 slides farther onto the plug housing 16, the distal end 124 of the top latching member 104, e.g., legs 120, move into the top opening 121. The proximal ends of the bottom legs 108 include beveled flanges 126 on their outer edges. The beveled flanges 126 are configured to mate with reciprocal grooves 128 formed in the side walls of the recess 112. As the TPA 80 slides onto the housing 16, the beveled flanges 126 engage in the grooves 128. The TPA 80 continues to slide onto the housing 16 until the distal cross member 110 engages against the first latching protrusion 116. (See FIG. 20B). Continued inward movement of the TPA 80 biases the cross member 110 up and over the first latching protrusion 116. The outer face of the first latching protrusion 116 is beveled to assist in lifting the cross member 110 over the protrusion 116. The interface between the beveled flanges 126 and the grooves 128 creates a pivot point for the bottom legs 108 as the cross member 110 moves past the first latching protrusion 116.

Once the distal cross member 110 moves past the first latching protrusion 116, the distal portions of the bottom legs 108 snap back into the recess 112. (See FIG. 20C). This position corresponds to the preset position of the TPA 80. When the TPA is at its preset position, the first latching protrusion 116 is captured in the longitudinal slot 114, and the cross member 110 is longitudinally positioned between the first and second latching protrusions 116, 118. Outward movement of the TPA 80 relative to the plug housing 16 is restricted by the interface between the cross member 110 and the first latching protrusion 116, whereas inward movement of the TPA 80 relative to the plug housing 16 is restricted by the interface between the cross member 110 and the second latching protrusion 118.

As can be seen in FIG. 14, when the TPA 80 is at its preset position, the top legs 120 are disengaged from the latch arms 88. Hence, when the TPA in its preset position, the plug terminals 42 can be inserted into the passages 82, as was explained above.

Once the terminals 42 are installed into the housing 16, the TPA 80 is moved to its fully engaged position to lock the terminals 42 into the housing 16. (See FIGS. 15 and 20D). As the TPA 80 moves from its preset position (FIGS. 14 and 20C) to its fully engaged position (FIGS. 15 and 20D), the protrusions 122 move into the passages 82 and engage against the tops of the terminals 42. The protrusions 122 exert downward forces on the terminals 42, which pushes the terminals down into the passages 82.

As the TPA 80 slides inwardly towards its fully engaged position, the distal cross member 110 engages against the second latching protrusion 118. The cross member 110 slides up and over second latching protrusion 118. Once the distal cross member 110 moves past the second latching protrusion 118, the bottom legs 108 snap back into the recess 112 to secure the TPA 80 to the housing 116 at its fully engaged position. (See FIGS. 15 and 20D). When the TPA 80 is in its fully engaged position, the second latching protrusion 118 is captured in the longitudinal slot 114. Outward movement of the TPA 80 relative to the plug housing 116 is restricted by the interface between the distal cross member 110 and the second latching protrusion 118, whereas inward movement of the TPA 80 relative to the plug housing 16 is restricted by the interface between the front wall 102 of the TPA and the front of the housing 16.

As the TPA 80 is moved from its partially engaged position to its fully engaged position, the distal ends 124 of the top legs 120 move into the space 130 between the latch beams 88 and the top wall 22 of the housing 16. (See FIGS. 14 and 15). When the TPA is fully engaged on the housing, the distal ends of the legs extend into the space 130 to restrict upward movement of the latch beams 88 sufficiently to prevent the terminals 42 from being withdrawn from the passages 82.

The plug 12 and receptacle 14 include first and second integral keying features which are adapted to mate with one another when the plug correctly is inserted into the receptacle. The keying features function to ensure proper orientation between the plug 12 and receptacle 14 before permitting full mating engagement therebetween. In addition, one of the keying features functions to prevent other plugs, which have the same size mating interface as the plug 12, from being inserted into the receptacle 14. The other keying feature functions to prevent plugs, which have smaller mating interfaces than does the plug 12, from being inserted into the receptacle 14. The combination of the first and second keying features is beneficial for ensuring that the proper plugs and receptacles are connected together, which is particularly advantageous in applications where multiple electrical connectors are located in a common area of a system.

One of the keying features is formed on the second side walls of the plug and receptacle opening, opposite the latch mechanism. The other keying feature may be formed on either the top or bottom walls of the plug and receptacle opening. In the illustrated embodiment, the first keying feature consists of mating ribs 140, 142 and slots 144, 146 formed on the second side walls 28, 37 of the plug 12 and the receptacle opening 33. (See FIGS. 1 and 21). Similarly, the second keying feature consists of mating rib 148 and slot 150 formed on the bottom walls 24, 38 of the plug 12 and the receptacle opening 33.

In a system having multiple plugs and receptacles of the same size, e.g. a plurality of 1×4 connectors assemblies, unique first keying features may be provided for each plug-receptacle combination. This is illustrated in FIGS. 21–24, which shows mating end elevation views of four different 1×4 connector assemblies 10A–10D. Each connector assembly includes a plug 12A–12D and a receptacle 14A–14D, respectively. The plug-receptacle connector assemblies 10A–10D have the same general construction to each other (and to that of the above described connector assembly 10), except for the specific construction of the first keying feature for a given connector assembly. In particular, each plug-receptacle connector assembly has a unique first keying feature formed on the second side walls 28, 37 of the plug and receptacle. This first keying feature functions to ensure that the plug and receptacle for a given connector assembly mate with one another in the correct orientation. In addition, this first keying feature prevents plugs of the same size, e.g., plugs 12B–D, from being inserted into the incorrect receptacle, e.g., receptacle 12A.

Figure 21:
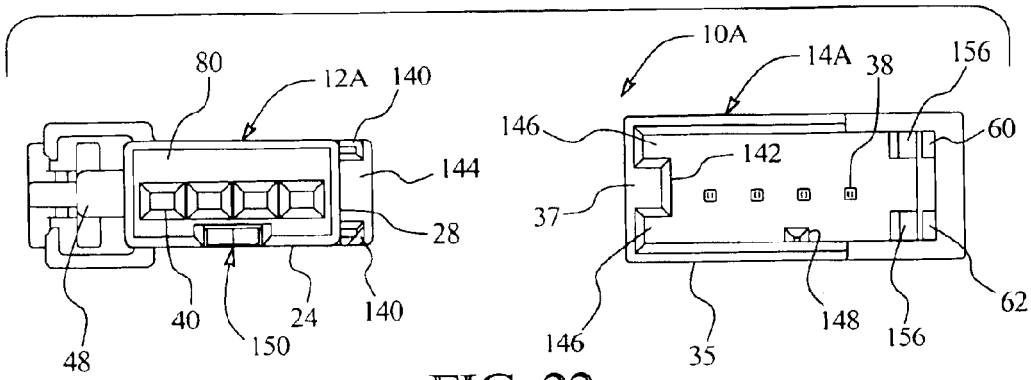
FIGS. 21–24 are mating end views of plugs and receptacles illustrating certain keying features of the electrical connector.

Specifically, FIG. 21 illustrates a first 1×4 connector assembly 10A having a first plug 12A and a first receptacle 14A. The first plug has two keying ribs 140 formed at the top and bottom of the second side wall 28 and a gap or slot 144 formed between the keying ribs 140. The first receptacle 14A has keying slots 146 formed at the top and bottom of its second side wall 37. When the first plug 12A is inserted into the first receptacle 14A in the proper orientation, the keying ribs 140 on the plug fit into the keying slots 146 in the receptacle. Conversely, if an attempt is made to insert the first plug 12A in the wrong orientation, e.g. upside-down, the keying ribs 140 on the first plug 12 abut against the latching protrusions 60, 62 in the first receptacle 14B, and the latch mechanism 48 abuts against the keying rib 142 on the second sidewall 37 of the receptacle 14A, thereby preventing insertion of the plug 12A into the receptacle 12B.

Figure 22:
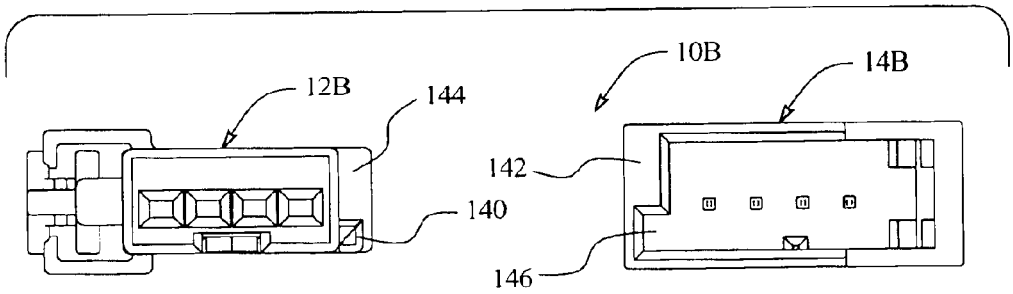

FIG. 22 illustrates a second 1×4 connector assembly 10B having a second plug 12B and a second receptacle 14B. The second plug 14B has a single keying rib 140 formed at the bottom of its second sidewall, while the second receptacle 14B has a reciprocal keying slot 146 formed at the bottom of its second side wall. When the plug 12B is inserted into the receptacle 14B in the correct orientation, the keying rib 140 on the plug 12B fits into the keying slot 146 in the receptacle. Conversely, if an attempt is made to insert the plug 12B in the wrong orientation, e.g. upside-down, the keying rib 140 on the second plug 12B abuts against the latching protrusions 60, 62 in the receptacle 12B and the latching mechanism 48 abuts against the rib 142 in the second sidewall of the receptacle 12B, thereby preventing insertion of the plug 12A into the receptacle 14B. As can be seen in the drawings, the bottom keying rib 140 of the second plug 12B is larger than the bottom keying rib 140 on the first plug 12A (and also the bottom keying slot 146) on the first receptacle 14A.

Figure 23:
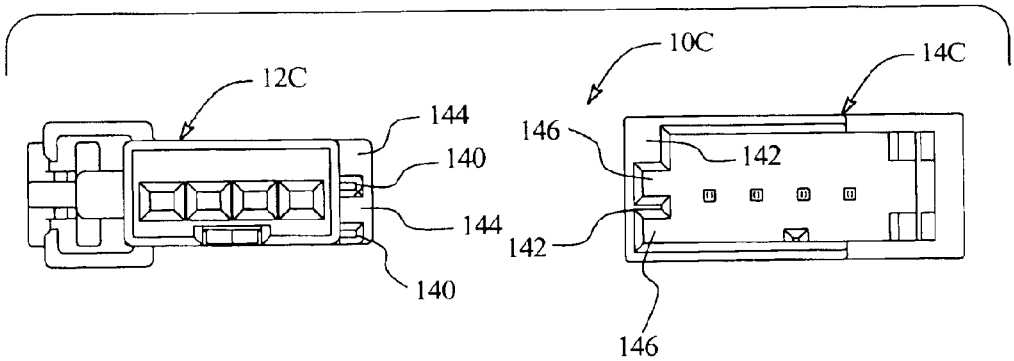

FIG. 23 illustrates a third 1×4 connector assembly 10C having a third plug 12C and a third receptacle 14C. The third plug 12C includes two keying ribs 140 formed at the bottom and middle of its second sidewall. The third receptacle 14C has reciprocal keying slots 146 formed at the bottom and middle of its second side wall. When the third plug 12C is inserted into the third receptacle 14C in the proper orientation, the keying ribs 140 on the plug fit into the keying slots 146 in the receptacle. Conversely, if an attempt is made to insert the third plug in the wrong orientation, e.g. upside-down, the keying ribs 140 on the third plug 12C abut against the latching protrusions 60, 62 in the third receptacle 14C, and the latching mechanism 48 abuts against second sidewall 28 of the receptacle.

Figure 24:
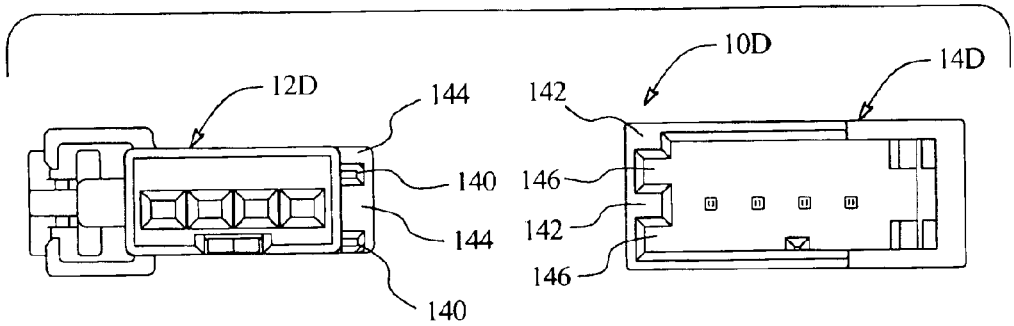

FIG. 24 illustrates a fourth 1×4 connector assembly 10D having a fourth plug 12D and a fourth receptacle 14D. The first keying feature of the fourth plug 14D includes a pair of keying ribs 140 formed at the bottom and upper middle, e.g. between the center and top, of the plug's second sidewall. The fourth receptacle 14D has reciprocal keying slots 146 formed at the bottom and upper middle of its second side wall. When the fourth plug 12D is inserted into the fourth receptacle 14D in the proper orientation, the keying ribs 140 on the fourth plug 12D slide into the keying slots 146 in the fourth receptacle 14D. Conversely, if an attempt is made to insert the fourth plug 12D in the wrong orientation, the keying ribs 14 on the fourth plug 12D abut against the latching protrusions 60, 62 in the fourth receptacle 14D, and the latching mechanism 48 abuts against the second sidewall of the fourth receptacle 14D.

As was discussed above, in addition to ensuring that the plugs 12A–12D and receptacles 14A–14D are mated in the correct orientation, the first keying feature also prevents plugs of the same size from being inserted into the incorrect receptacle. For example, if an attempt is made to mate the first plug 12A with the second receptacle 14B, the top keying rib 140 on the first plug 12A will abut the rib 142 in the second receptacle 14B.

As can be seen in FIGS. 4–6 and 21–24, the second keying feature consists of reciprocal keying ribs 148 and slots 150 formed on the bottom walls of the plug 12 and receptacle 14. The second keying feature is identical on all of the plugs and receptacles of a given size. For example, in FIGS. 21–24, each of the 1×4 plugs includes a bottom keying slot 148 defined by the longitudinal slot 114 in the TPA 80. The keying slot 148 is configured to align and mate with a reciprocal keying rib 148 formed in the bottom wall of the receptacle. The lateral space 152 between the first latching protrusion 116 and the leg 108 of the TPA 80 defines a reduced width keying slot that receives the front end of the keying rib 148 when the plug and receptacle are fully mated. (See FIG. 6). It will be appreciated, that the keying rib 148 could have an increased width rear portion (not shown) of approximately the same width as the longitudinal slot 114. The receptacle 14 may also include ribs 156 formed along the first side wall of the receptacle. The ribs 156 are located inwardly of the latching protrusion 60, 62 and are sized to fit in the gaps above and below the latching beam when the plug 12 is inserted into the receptacle 14. The ribs 156 help to guide the plug 12 into the receptacle 14 and facilitate correct mating of the receptacle pins 38 into the plug's terminals 40.

Figure 25:
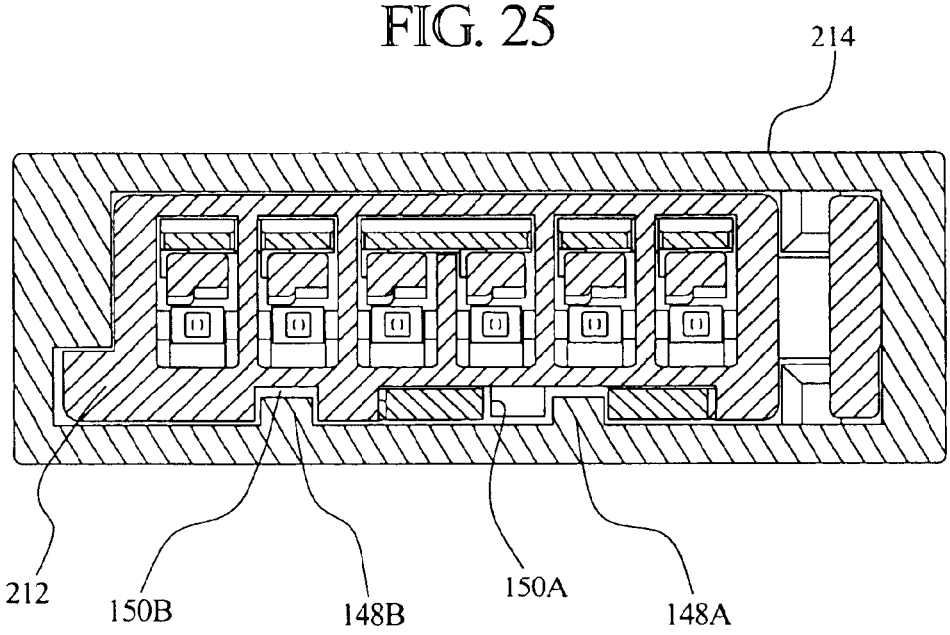
FIG. 25 is a cross-sectional view of a 1×6 plug mated with a 1×6 receptacle.
Figure 26:
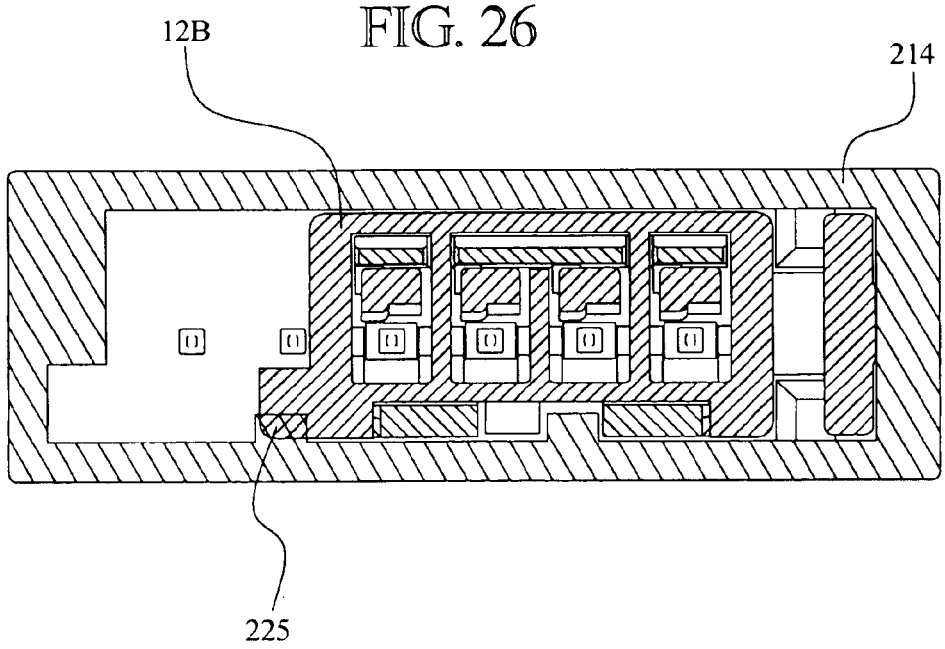
FIG. 26 is a cross-sectional view illustrating the manner in which certain keying features of the electrical connector function.

In applications that have connector assemblies of different sizes, the second keying feature is used to prevent smaller plugs, e.g. a 1×4 plug, from being inserted into a larger receptacle, e.g. a 1×6 receptacle. This is illustrated in FIGS. 25 and 26. FIG. 25 is a cross-sectional view illustrating a 1×6 plug 212 correctly mated with a 1×6 receptacle 214. The second keying feature in the 1×6 plug 212 consists of first and second keying slots 150*a*, 150*b* formed in the bottom of the plug. One of the keying slots 150*a* is defined by the longitudinally extending slot 114 in the TPA 80, in the same manner as was discussed above. The other keying slot 150*b* is shown as being formed directly in the bottom wall of the plug housing. As will be appreciated, a portion of the slot is also defined by the front wall of the TPA. The 1×6 receptacle 214 includes reciprocal first and second keying ribs 148*a*, 148*b* in its bottom wall. The keying ribs 148*a*, 148*b* are sized and positioned to mate with the first and second keying slots 150*a*, 150*b* in the plug 212 when the plug is inserted into the receptacle. However, when, as is shown in FIG. 26, an attempt is made to insert a smaller plug, e.g. a 1×4 plug 12B, into the 1×6 receptacle the second rib 148*b* on the receptacle abuts against the bottom keying rib 140 on the plug's second side wall, thereby preventing the plug from being inserted into the receptacle. In FIG. 26, the interference between the ribs 140, 148*b* is shown by the double crosshatch 225.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

a plug having a housing with front and rear ends, the front end including a mating interface, the housing having a long top wall, a long bottom wall and short side walls;

a receptacle having an opening configured to receive the mating interface of the plug;

a deflectable latch including a beam disposed along one of the sidewalls, the beam having a front end secured to the plug housing proximate the front end of the plug housing, the beam extending from the front end of the plug housing rearward toward the rear end of the plug housing, the beam having a rear, free-standing end which is biasable towards the plug to permit the plug and receptacle to be mated with one another, the latch further including first and second latching projections that are biasable towards the plug and that extend from opposite sides of the beam; and first and second latch mating elements formed within the receptacle opening, the first and second latch mating elements being positioned to securely engage the first and second latching projections when the plug and receptacle housings are fully mated with one another.

2. A connector assembly as set forth in claim 1, wherein the plug includes a cut out portion in the side wall underlying the rear end of the latch beam for permitting increased inward deflection of the latch beam relative to the plug.

3. A connector assembly as set forth in claim 1, wherein the rear end of the latch beam includes a beveled inner face for permitting increased inward deflection of the latch beam relative to the plug.

4. A connector assembly as set forth in claim 1, wherein the first and second latching projections are longitudinally aligned with one another along the length of the latch beam.

5. A connector assembly as set forth in claim 1, further comprising:

a plug keying feature formed along the side eall of the plug housing opposite the latch; and a receptacle keying feature formed within the receptacle opening for mating with the plug keying feature.

6. A connector assembly as set forth in claim 1, wherein a width of the top wall is greater than a height of the side walls.

7. A connector assembly as set forth in claim 1, wherein an overall height of the latch is substantially the same as a height of the side walls.

8. A connector assembly as set forth in claim 1, wherein a distance between outer edges of the first and second latching projections is substantially the same as a height of the side walls.

9. A connector assembly as set forth in claim 1, further comprising a terminal position assurance device (TPA) configured to mate with the housing proximate to the mating interface.

10. An electrical connector assembly comprising:

a plug having a housing with front and rear ends, the front end including a mating interface, the housing having a top wall, a bottom wall and side walls;

a receptacle having an opening configured to receive the mating interface of the plug;

a deflectable latch including a beam disposed along one of the side walls, the beam having a front end secured with the front end of the plug housing, and a rear, free-standing end which is biasable towards the plug to permit the plug and receptacle to be mated with one another, the latch further including first and second latching projections that are biasable towards the plug and that extend from opposite sides of the beam; and first and second latch mating elements formed within the receptacle opening, the first and second latch mating elements being positioned to securely engage the first and second latching projections when the plug and receptacle housings are fully mated with one another, wherein overall height of the latch, as measured between outer edges of the first and second latching projections, is substantially the same as a height of the side walls of said housing.

11. An electrical connector assembly comprising:

a plug having a housing with front and rear ends, the front end including a mating interface, the housing having a top wall, a bottom wall and side walls;

a receptacle having an opening configured to receive the mating interface of the plug;

a deflectable latch including a beam disposed along one of the side walls, the beam having a front end secured with the front end of the plug housing and a rear, free-standing end which is biasable towards the plug to permit the plug and receptacle to be mated with one another, the latch further including first and second latching projections that are biasable towards the plug and that extend from opposite sides of the beam;

first and second latch mating elements formed within the receptacle opening, the first and second latch mating elements being positioned to securely engage the first and second latching projections when the plug and receptacle housings are fully mated with one another; and a terminal position assurance device (TPA) configured to mate with the housing, the TPA having a front wall and top and bottom opposed latching members extending from the front wall and being configured to engage the housing to secure the TPA to the mating interface.

12. A connector assembly as set forth in claim 11, wherein the second plug keying feature comprises a longitudinal slot formed in one of the top and bottom latching members of the TPA.

13. A connector assembly as set forth in claim 12, further comprising first and second latching protrusions extending from the plug housing, the first latching protrusion being positioned to mate with the longitudinal slot to maintain the TPA in a preset position and the second latching protrusion being positioned to mate with the longitudinal slot to maintain the TPA in a fully engaged position.

* * * * *